US005962179A

United States Patent [19]

Agur et al.

[11] Patent Number: 5,962,179

[45] Date of Patent: Oct. 5, 1999

[54] TONER PROCESSES

[75] Inventors: Enno E. Agur, Toronto, Canada; Francisco E. Torres, San Mateo, Calif.; T. Hwee Ng, Mississauga, Canada; Allan K. Chen, Oakville, Canada; Arthur Helbrecht, Oakville, Canada; Maria N. V. McDougall, Burlington, Canada; Richard P. N. Veregin, Mississauga, Canada

[73] Assignee: Xerox Corporation, Stamford, Conn.

[21] Appl. No.: 09/191,713

[22] Filed: Nov. 13, 1998

[51] Int. Cl.[6] ..... G03G 9/087

[52] U.S. Cl. ..... 430/137

[58] Field of Search ..... 430/109, 137

[56] References Cited

U.S. PATENT DOCUMENTS

| | | | |
|---|---|---|---|
| 4,935,326 | 6/1990 | Creatura et al. | 430/108 |
| 4,937,166 | 6/1990 | Creatura et al. | 430/108 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,525,452 | 6/1996 | Hopper et al. | 430/137 |
| 5,527,658 | 6/1996 | Hopper et al. | 430/137 |
| 5,585,215 | 12/1996 | Ong et al. | 430/107 |
| 5,650,225 | 7/1997 | Ng et al. | 430/137 |
| 5,650,256 | 7/1997 | Veregin et al. | 430/137 |
| 5,766,818 | 6/1998 | Smith et al. | 430/137 |
| 5,863,698 | 1/1999 | Patel et al. | 430/137 |

*Primary Examiner*—Roland Martin
*Attorney, Agent, or Firm*—E. O. Palazzo

[57] ABSTRACT

A process for the preparation of toner comprising mixing a colorant dispersion in water, which dispersion is comprised of a colorant and an ionic surfactant with a resin latex; heating the resulting flocculent mixture with stirring at a temperature of from about 25° C. to about 1° C. below the glass transition temperature (Tg) of the latex resin to effect formation of toner sized aggregates; heating the resulting aggregate suspension in the presence of additional anionic surfactant, and which heating is at a temperature of from about 10° C. to about 55° C. above the Tg of the resin; cooling; adding a base component to the resulting slurry; filtering; and thereafter drying said toner.

27 Claims, No Drawings

TONER PROCESSES

BACKGROUND OF THE INVENTION

The present invention is generally directed to toners, and toner processes, and more specifically, to a process which comprises the aggregation of latex resin particles with colorant, especially pigments, and optionally additive toner particles into toner sized aggregates, followed by coalescence or fusion by heating of the resulting aggregates to form integral toner particles, and thereafter, washing with a base component, and more specifically, wherein washing is accomplished with, for example, a base of an alkali metal hydroxide subsequent to coalescence thereby enabling, for example, improved toner triboelectric charging characteristics and excellent batch to batch reproducibility. In embodiments, the present invention is directed to a chemical in situ process for generating toners without resorting to conventionally known pulverization and classification methods, thus rendering the process economical, and wherein toner compositions can be obtained with a particle size as herein illustrated by volume average diameter of, for example, from about 1 to about 25, and preferably from 2 to about 10 microns, and narrow particle size distribution as conventionally characterized by GSD (geometric standard deviation) of, for example, from about 1.10 to about 1.35, and more specifically, from about 1.15 to about 1.25 as measured on the Coulter Counter. The resulting toners can be selected for known electrophotographic imaging and printing processes.

The size of the formed aggregates is primarily dependent on the temperature at which aggregation is accomplished, and for a particular latex composition, larger aggregates can be obtained at higher temperatures, provided that the temperature is not substantially above the Tg (glass transition temperature) of the latex resin. Also, the particle size distribution of the aggregates does not appear to be primarily dependent on the aggregation temperature, and this size is generally narrow as typified by a GSD of less than about 1.35, and more specifically, of less than about 1.25. These aggregates, which for example, have a volume average diameter of about 1 to 20 microns, are then subjected to further heating, optionally in the presence of additional anionic surfactant at a temperature above equal to about, or about the Tg of the resin, and more specifically, at a temperature ranging from about 10° C. to about 50° C. above the Tg for an effective time period, for example about 2 hours in embodiments, to effect fusion or coalescence of the latex particles within the aggregates affording integral toner particles. The degree of coalescence is dependent, for example, on the temperature and duration of the heating. Suitable temperatures for coalescence range, for example, from about equal to, or slightly above the resin Tg to in excess of about 100° C., depending on the nature of the latex resin, its composition, and the colorant and optional additives. In general, the coalescence is conducted at a temperature of between about 65° C. to about 110° C., and preferably between about 75° C. to about 105° C. The resulting toner particles retain the size of the precursor aggregates, that is, the volume average particle size of the aggregate is preserved during coalescence wherein electrostatically bound aggregates are converted to integral toner particles as a result of the fusion of the resin particles within the aggregate particles. Subsequently, the toner is formed into a slurry with a base, followed by mixing and washing the toner.

PRIOR ART

In U.S. Pat. No. 5,366,841, the disclosure of which is totally incorporated herein by reference, there are illustrated emulsion/aggregation processes, and more specifically, a process for the preparation of toner compositions comprising:

(i) preparing a pigment dispersion in water, which dispersion is comprised of a pigment, an ionic surfactant and optionally a charge control agent;

(ii) shearing the pigment dispersion with a latex blend comprised of resin particles, an ionic surfactant of opposite charge polarity to that of said ionic surfactant in the pigment dispersion and a nonionic surfactant thereby causing a flocculation of resin, pigment, and charge control additive particles to form a uniform dispersion of solids in the water, and surfactant;

(iii) heating the above sheared blend at a temperature region about equal to or above the glass transition temperature (Tg) of the resin, while continuously stirring to form electrostatically bounded toner size aggregates with a narrow particle size distribution and wherein the temperature is from about 0° C. to about 10° C. above the resin Tg, and wherein the resin Tg is from about 30° C. to about 65° C. and preferably in the range of from about 45° C. to about 65° C.;

(iv) heating the statically bound aggregated particles from about 10° C. to about 45° C. above the Tg of the resin particles to provide a toner composition comprised of polymeric resin, pigment and optionally a charge control agent; and (v) optionally separating and drying the toner.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,501,935; and 5,766,818.

Also, U.S. Pat. No. 5,650,256, the disclosure of which is totally incorporated herein by reference, illustrates emulsion aggregation/coalescence processes wherein a base component can be used in the process.

The appropriate components and processes of these patents and other related patents, such as the U.S. Pat. No. 5,650,256, can be selected for the processes of the present invention in embodiments thereof.

SUMMARY OF THE INVENTION

Examples of features of the present invention in embodiments thereof include:

It is a feature of the present invention to provide toner compositions and processes with many of the advantages illustrated herein.

Another important feature of the present invention resides in the provision of toners with stable excellent triboelectric charging characteristics and which toners can possess high image gloss, and excellent image fix at low fusing temperatures.

In another feature of the present invention there are provided simple and economical processes for the direct preparation of black and colored toner compositions with, for example, excellent colorant dispersion to enable high image color fidelity and excellent image projection efficiency.

In another feature of the present invention there are provided simple and economical chemical processes for black and colored toner compositions in which latex, colorant, and additive particles aggregate to form electrostatically bound toner sized aggregates, followed by coalescence wherein the latex resin particles within the aggregates coalesce and fuse together to provide integral toner particles.

In a further feature of the present invention there is provided a process for the preparation of toner particles with a volume average diameter of from between about 2 to about 10 microns, and with a narrow GSD of from about 1.10 to about 1.35 without the need for particle size classification.

In a further feature of the present invention there is provided a chemical process for the preparation of toner compositions by aggregation and coalescence of latex, colorant, and optional additive particles with the resultant toner particle size being precisely achieved through proper control of the temperature at which aggregation is accomplished, and which temperature is generally in the range of from about 25° C. to about 65° C.

In yet another feature of the present invention there are provided toner compositions with batch to batch reproducibility.

In another feature of the present invention there are provided toner compositions which provide high image projection efficiency of, for example, from over 65 to over 95 percent as measured by the Match Scan II spectrophotometer available from Milton-Roy.

In a further feature of the present invention there are provided toner compositions, which when effectively fused on paper substrate, afford minimal or no paper curl.

These and other features of the present invention are accomplished in embodiments by the provision of toners and processes thereof; and more specifically, emulsion/aggregation/coalescence processes for the preparation of toner wherein washing to primarily to remove surfactants is accomplished after coalescence. More specifically, subsequent to coalescence of the toner aggregates there is added to the slurry a base, such as an alkali metal hydroxide, an ammonium hydroxide and the like to the coalesced toner contained in a slurry, and which adding is accomplished at a basic pH, for example from about 7 to about 12, and preferably from about 8 to about 9, followed by stirring, removal of the mother liquor by, for example, filtration or centrifugation, recovery of the toner by the addition of, for example, deionized water, optionally increasing the pH to the aforementioned value in the range of from about 7 to about 12, and preferably from about 8 to about 9, stirring, removing water and repeating a number of times, such as from 1 to about 20, and preferably from about 3 to about 6 times.

Aspects of the present invention relate to a process for the preparation of toner comprising mixing a colorant dispersion in water, which dispersion is comprised of a colorant and surfactant, preferably a cationic surfactant, with a resin latex, and which resin latex preferably contains a nonionic surfactant, or an anionic surfactant; heating the resulting flocculent mixture with stirring at a temperature of from about 25° C. to about 1° C. below the glass transition temperature (Tg) of the latex resin to effect formation of toner sized aggregates; heating the resulting aggregate suspension in the presence of additional surfactant, preferably an anionic, and which heating is at a temperature of from about 10° C. to about 55° C. above the Tg of the resin; cooling; adding a base component to the resulting slurry; filtering; and thereafter drying the toner; a process wherein the base component is added to the toner slurry containing water, and there is added (i) a base component to the resulting toner mixture in an amount to increase the pH of the mixture to a basic pH in the range of from about 7 to about 12, followed by;

(ii) stirring the toner mixture;

(iii) removing the toner from the mixture;

(iv) reslurrying the recovered toner by adding water in an amount from about 100 to about 2,000 percent by weight of toner;

(v) optionally adding base to the resulting toner mixture in an amount to increase the pH of the mixture to about 7 to about 12;

(vi) stirring the toner mixture;

(vii) removing the toner from the mixture; and (viii) repeating the aforementioned washing (iv) to (vii) from 1 to about 20 times; a process for the preparation of toner comprising mixing a colorant and a latex containing a surfactant; heating the mixture resulting to about equal to or about below the Tg of the polymer contained in the latex; heating the resulting mixture to about equal to or above about the polymer Tg; adding a base to the resulting toner slurry; and filtering; toner processes comprising:

(i) preparing, or providing a colorant dispersion, which dispersion is comprised of a colorant, water, a cationic surfactant and an optionally a charge control agent;

(ii) shearing a resin latex containing an ionic surfactant having an opposite charge polarity to that of the ionic, preferably cationic, surfactant in the colorant dispersion, thereby causing a flocculation of the resin, colorant, surfactants, and optional charge control agent;

(iii) heating the resulting flocculent mixture with stirring at a temperature of from about 25° C. to about 1° C. about equal to, or about below the glass transition temperature (Tg) of the latex resin to effect formation of electrostatically bounded toner sized aggregates with, for example, a narrow aggregate size distribution, and wherein the resin has a Tg of from about 45° C. to about 65° C.;

(iv) heating the resulting aggregate suspension in the presence of additional anionic surfactant selected in an amount of, for example, from about 0.01 to about 5 weight percent of the total reaction mixture, and which heating is at a temperature of from about 10° C. to about 55° C. above the Tg of the resin to form integral coalesced toner particles comprised of a polymeric resin, colorant, and optionally a charge control agent; cooling, for example, to about from 25 to about 40° C.;

(v) adding a base to the resulting toner mixture in an amount sufficient to increase the pH of the mixture resulting to a basic pH in the range of from, for example, about 7 to about 12, and preferably from about 8 to about 9;

(vi) stirring the toner mixture using, for example, a mechanical stirrer for a period of time from about 5 minutes to about 6 hours, and preferably from about 10 minutes to about 60 minutes;

(vii) removing the toner from the mixture by mechanical separation such as for example filtration or centrifugation;

(viii) reslurrying the recovered toner by adding a suitable component, such as deionized water in an amount from about 100 to about 2,000 percent by weight of toner;

(ix) optionally again adding base to the toner mixture in an amount to increase the pH of the mixture to the same level as the aforementioned pH adjustment step (v), that is, to a basic pH in the range of from about 7 to about 12, and preferably from about 8 to about 9;

(x) stirring the toner mixture using, for example, a mechanical stirrer for a period of time from about 5 minutes to about 6 hours, and preferably from about 10 minutes to about 60 minutes;

(xi) removing the toner from the mixture by mechanical separation, such as for example filtration or centrifugation;

(xii) repeating the aforementioned washing steps (viii) to (xi) a number of times, such as from 1 to about 20, and preferably from about 3 to about 6; and (xiii) drying the toner, such as by use of an Aeromatic fluid bed dryer, freeze dryer or spray dryer whereby toner particles comprised of resin and colorant, such as dye, or pigment with various particle sizes can be obtained, such as from about 1 to about 20 microns in volume average diameter as measured by the Coulter Counter; processes for the preparation of toner compositions which comprise initially preparing an ionic pigment dispersion, for example by homogenizing an aqueous mixture of a pigment or pigments, such as carbon black like REGAL 330®, phthalocyanine, quinacridone, or RHODAMINE B™ type, yellow, red, green, brown, blue, and the like, and optional additive particles with a cationic surfactant, such as benzalkonium chloride by means of a high shearing device, such as a Brinkmann Polytron, thereafter blending this mixture using a high shear device, such as a polytron, a sonicator or microfluidizer, with a latex emulsion comprised of resin particles stabilized with an anionic surfactant, such as sodium dodecylbenzene sulfonate, and nonionic surfactants, and wherein the latex resin size ranges, for example, from about 0.01 to about 1.0 micron, thereby enabling, by the blending, the flocculation of latex, pigment and optional additive particles; heating resulting the mixture at a temperature of preferably from about 25° C. to about 1° C. below the Tg of the latex resin with mechanical stirring to effect formation of electrostatically bound aggregates with an average aggregate size ranging from, for example, about 1 to about 20 microns, and preferably from about 2 to 10 microns; followed by the addition of anionic surfactant, and heating of the resultant mixture at a temperature of preferably from about 10° C. to about 50° C. above the Tg of the latex resin to effect coalescence, or fusing of the latex particles within the aggregates to form integral toner particles; adding a base like potassium hydroxide or ammonium hydroxide to the resulting toner mixture in an amount sufficient to increase the pH of the mixture to a basic pH in the range of from about 7 to about 12, and preferably from about 8 to about 9; stirring the toner mixture using a mechanical stirrer for a period of time from about 5 minutes to about 2 hours, and preferably from about 10 minutes to about 60 minutes; removing the toner from the mixture by mechanical separation, such as for example filtration or centrifugation; reslurrying the recovered toner by adding deionized water in an amount from about 100 to about 2,000 percent by weight of toner; adding base to the toner mixture in an amount to increase the pH of the mixture to the same level as in aforementioned pH adjustment step, that is, to a basic pH in the range of from about 7 to about 12, and preferably about from about 8 to about 9; stirring the toner mixture using a mechanical stirrer for a period of time from about 5 minutes to about 2 hours, and preferably from about 10 minutes to about 60 minutes; removing the toner from the mixture by mechanical separation, such as for example filtration or centrifugation; repeating the aforementioned washing steps a number of times, such as from 1 to about 20, and preferably from about 3 to about 6; and optionally drying the toner, such as by use of an Aeromatic fluid bed dryer, freeze dryer or spray dryer whereby toner particles comprised of resin, pigment and optional additives with various toner particle sizes can be obtained, such as from about 1 to about 10 microns in volume average diameter as measured by the Coulter Counter; a process for the preparation of toner comprising:

(i) preparing, or providing a colorant dispersion in water, which dispersion is comprised of a colorant, and an oppositely charged cationic surfactant;

(ii) shearing with a polymer or resin latex thereby causing a flocculation of the resin, colorant, and surfactant;

(iii) heating the resulting flocculent mixture with stirring at a temperature of from about 25° C. to about 1° C. below the glass transition temperature (Tg) of the latex resin to effect formation of aggregates, or aggregates, and wherein the resin has a Tg of from about 45° C. to about 65° C.;

(iv) heating the resulting aggregate suspension in the presence of additional anionic surfactant selected in an amount of, for example, from about 0.01 to about 5 weight percent of the total reaction mixture solids, and which heating is at a temperature from about 10° C. to about 55° C. above the Tg of the resin to form a dispersion or slurry of toner particles comprised of a polymeric resin, and colorant;

(v) adding a base like potassium hydroxide or ammonium hydroxide to the resulting toner mixture in an amount to increase the pH of the mixture to a basic pH in the range of from about 7 to about 12, and preferably from about 8 to about 9;

(vi) stirring the toner mixture with, for example, a mechanical stirrer for a period of time of, for example, from about 5 minutes to about 2 hours, and preferably from about 10 minutes to about 60 minutes;

(vii) removing the toner from the mixture by mechanical separation such as for example filtration or centrifugation;

(viii) reslurrying the recovered toner by adding deionized water in an amount from about 100 to about 2,000 percent by weight of toner;

(ix) adding base to the toner mixture in an amount to increase the pH of the mixture to from about 7 to about 12, and preferably from about 8 to about 9;

(x) stirring the toner mixture using a mechanical stirrer for a period of time from about 5 minutes to about 2 hours, and preferably from about 10 minutes to about 60 minutes;

(xi) removing the toner from the mixture by mechanical separation such as for example filtration or centrifugation;

(xii) repeating the aforementioned washing steps (viii) to (xi) a number of times, such as from 1 to about 20, and preferably from about 3 to about 6; and (xiii) drying the toner, such as by use of an Aeromatic fluid bed dryer, freeze dryer or spray dryer, a process wherein the aggregate size, and the final toner particle size is from about 1 to about 20 microns in volume average diameter as measured with a Coulter Counter; a process wherein narrow GSD is from about 1.15 to about 1.25; wherein the ionic surfactant utilized in preparing the colorant dispersion is a cationic surfactant, and the ionic surfactant present in the latex emulsion is anionic; wherein the dispersion (i) is accomplished by homogenizing at from about 1,000 revolution per minute to about 10,000 revolutions per minute by microfluidization in a microfluidizer or in nanojet, or by an ultrasonic probe at from about 300 watts to about 900 watts of energy at a temperature of from about 25° C. to about 35° C. for a duration of from about 1 minute to about 120 minutes; wherein the heating of the flocculent mixture of latex, colorant, surfactants and optional charge control agent in (iv) is accomplished at temperatures of from about 2° C. to about 10° C. below the resin Tg for a duration of from about 30 minutes to about 6 hours; wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly (ethyleneoxy)ethanol; and wherein the anionic surfactant is selected from the group consisting of sodium dodecyl sulfate, sodium dodecylbenzene sulfate, and sodium dodecylnaphthalene sulfate; wherein the base is an alkali metal hydroxide, such as sodium hydroxide, potassium hydroxide, lithium hydroxide, beryllium hydroxide, magnesium hydroxide, calcium hydroxide, or barium hydroxide; ammonium hydroxide; an alkali metal carbonate, such as sodium bicarbonate, lithium bicarbonate, potassium bicarbonate, lithium carbonate, potassium carbonate, sodium carbonate, beryllium carbonate, magnesium carbonate, calcium carbonate, or barium carbonate.

Various known colorants, such as pigments, dyes, mixtures thereof, and the like present in the toner in an effective amount of, for example, from about 1 to about 20, and preferably from about 2 to about 12 percent by weight of the toner, and more preferably in an amount of from about 3 to about 10 weight percent, that can be selected include carbon black like REGAL 330®, REGAL 660®, REGAL 400®, REGAL 400®, REGAL 330R ®, REGAL 660R ® and other equivalent black pigments. As colored pigments, there can be selected known cyan, magenta, red, green, blue, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Colorant includes for example pigments, dyes, mixtures of pigments and dyes, mixtures of pigments, mixtures of dyes, and the like.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference; nitrobenzene sulfonates; TRH a known charge enhancing additive aluminum complex, BONTRON E-84™ and E-88™, available from Orient Chemicals, and other known charge enhancing additives, and the like. Mixtures of charge additives may also be selected.

Examples of anionic surfactants selected for the emulsion polymerization and for preparation of the latex resin for the toner compositions of the present invention include, for example, sodium dodecylsulfate, sodium dodecylbenzene sulfonate, sodium dodecylnaphthalene sulfate, dialkyl benzenealkyl, sulfates and sulfonates, abetic acid, available from Aldrich, NEOGEN R™, NEOGEN SC™ obtained from Kao and the like. One effective concentration of the anionic surfactant is, for example, from about 0.01 to about 10 percent by weight, and preferably from about 0.1 to about 5 percent by weight of the latex resin.

Illustrative examples of nonionic surfactants selected in amounts of, for example, from about 0.01 to about 10 percent by weight, and preferably from about 0.1 to about 5 percent by weight of latex resin in embodiments, include dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

Cationic surfactant examples utilized in the colorant dispersion for the toners and processes of the present invention include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 to about 10 percent by weight of latex resin. Generally, the molar ratio of the cationic surfactant in the pigment dispersion to the anionic surfactant utilized in the latex preparation is in the range of from about 0.05 to about 4, and preferably from 0.05 to 2.

Examples of the additional surfactants, which are preferably added prior to coalescence to prevent or minimize further growth in aggregate size with temperature, include anionic surfactants, such as sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ obtained from Kao and the like, and nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. One effective concentration of this added surfactant that primarily functions to stabilize the aggregate size during coalescence ranges, for example, from about 0.01 to about 10 percent by weight, and preferably from about 0.05 to about 5 percent by weight of the total weight of reaction mixture solids.

Bases that can be selected to increase the pH of the toner mixture during washing and prior to separation of the mother liquor include alkali metal hydroxides, such as sodium hydroxide, potassium hydroxide, lithium hydroxide, beryllium hydroxide, magnesium hydroxide, calcium hydroxide, or barium hydroxide; ammonium hydroxide; an alkali metal carbonate, such as sodium bicarbonate, lithium bicarbonate, potassium bicarbonate, lithium carbonate, potassium carbonate, sodium carbonate, beryllium carbonate, magnesium carbonate, calcium carbonate, or barium carbonate. The amount of base added can be varied to adjust the pH of the toner mixture resulting to a basic pH in the range of from about 7 to about 12, and preferably from about 8 to about 9. For example, metal hydroxide, such as for example about a 1 M (molar) aqueous solution of potassium hydroxide, can be added to the toner mixture in an amount from about 10 to about 50 percent by weight of toner to increase the pH of the toner mixture to from about 7 to about 12; or a hydroxide, such as ammonium hydroxide can be, for example, about 14.5 M aqueous solution of ammonium hydroxide in an amount from about 100 to about 800 percent by weight of toner to increase the pH of the toner mixture to from about 7 to about 12. The pH is measured by known methods, such as a pH meter.

Surface additives that can be added to the toner compositions after, for example, washing and drying include, for example, those mentioned herein, such as metal salts, metal salts of fatty acids, metal oxides, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa, each in amounts of from 0.1 to 2 percent, which can also be added during aggregation or coalescence, washing or drying, and wherein the additives are mechanically coated onto the surface of the toner product.

Illustrative examples of latex resins or polymers selected for the process of the present invention include known polymers such as poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. The resin selected in embodiments is present in various effective amounts, such as for example, from about 85 weight percent to about 98 weight percent of toner, and the latex particle size can be for example, from about 0.05 micron to about 1 micron in average volume diameter as measured by the Brookhaven nanosize particle analyzer. Other sizes and effective amounts of latex particles may be selected in embodiments. The total of all toner components, such as resin, colorant, and optional toner additives is equal to about 100 percent, or parts.

The resin selected for the process of the present invention can preferably be prepared by emulsion polymerization methods, and the monomers utilized in such processes include styrene, acrylates, methacrylates, butadiene, isoprene, acrylonitrile, acrylic acid, and methacrylic acid. Known chain transfer agents, for example dodecanethiol in effective amounts of for example from about 0.1 to about 10 percent, and/or carbon tetrabromide in effective amounts of from about 0.1 to about 10 percent, can also be employed to control the resin molecular weight during the polymerization. Other processes of obtaining resin particles of from, for example, about 0.05 microns to about 1 micron can be selected from polymer microsuspension process, such as the processes disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Developer compositions can be prepared by blending the toners obtained with the processes of the present invention with known carrier particles, including coated carriers, such as steel, iron, ferrites, and the like, reference U.S. Pat. Nos. 4,937,166 and 4,935,326, the disclosures of which are totally incorporated herein by reference, for example from about 2 percent toner concentration to about 8 percent toner concentration.

The toners of the present invention may also contain functional waxes, such as alkylenes, such as polypropylenes, and polyethylenes halogenated functional waxes, and wherein the functional group can for example be an amide, an amine, and the like. These waxes can be selected for the toner in various effective amounts, such as for example from about 0.5 to about 20, and preferably from about 1 to about 7 weight percent.

The following Examples are being submitted to further define the various aspects of the present invention. These Examples are intended to be illustrative only and are not intended to limit the scope of the present invention. Comparative Examples and data are also provided.

EXAMPLE 1

A surfactant solution of 7.7 kilograms of NEOGEN R™ anionic surfactant and 3.7 kilograms of ANTAROX CA-897™ nonionic surfactant in 60 liters of deionized water was charged into a 300 gallon reactor. To the surfactant solution was added a solution of 3.4 kilograms of ammonium persulfate initiator in 50 kilograms of deionized water. The reactor jacket was set to maintain a temperature of 25° C. Separately, a mixture of 3.4 kilograms of carbon tetrabromide, 6.8 kilograms of acrylic acid, and 11.9 kilograms of dodecanethiol was added to the monomer mixture of 280 kilograms of styrene and 61 kilograms of n-butyl acrylate. The mixture was then charged into the 300 gallon reactor maintained under a nitrogen atmosphere by a continuous stream of nitrogen purging through the reactor system. The reactor agitator was started and the nitrogen purge maintained until the reactor reaches 70° C. at which time the reactor was completely sealed. The reactor temperature was programmed to the following heating profile: 25° C. for 30 minutes, raising the temperature from 25° C. to 45° C. at a rate of 1° C. per minute, from 45° C. to 53° C. at a rate of 0.5° C. per minute, from 53° C. to 55° C. at a rate of 0.3° C. per minute, and from 55° C. to 70° C. at a rate of 0.1° C. per minute. Subsequently, the mixture was retained at 70° C. for 4 hours before cooling down to room temperature, about 25° C., and discharged into plastic drums. The latex product obtained was subjected to centrifugation at 3,000 rpm for 2 minutes to, for example, remove about 5 percent by weight of low molecular weight materials having a weight-average molecular weight ($M_w$) in the range from about 6,000 to about 10,000. The resulting latex exhibited the following properties: $M_w$ of about 30,400 and number-average molecular weight ($M_n$) of about 4,800 as measured by gel permeation chromotography (GPC), particle size of about 200 nanometers as measured with a Brookhaven disc centrifuge system, and midpoint glass transition temperature (Tg) of about 55° C. as measured by differential scanning calorimetry (DSC).

206 Kilograms of the above latex and 158 kilograms of an aqueous cyan pigment dispersion containing 6.0 kilograms of Cyan Pigment 15:3 and 2.0 kilograms of cationic surfactant, SANIZOL B™, were added to 310 liters of deionized water and stirred using a three stage inline homogenizer operating at 3,600 revolutions per minute. The resulting mixture was transferred to a 300 gallon reactor, heated at 0.5° C. per minute to a temperature of 50° C., and held there for 1 hour before 23 kilograms of a 16 percent aqueous NEOGEN R™ solution were added. Subsequently, the mixture was heated to 95° C. and held there for a period of 3.5 hours before cooling down to room temperature, about 25° C. throughout, and discharging into plastic drums. The resulting toner mixture was comprised of about 12 percent by weight of toner, about 0.7 percent by weight of surfactant and about 87.3 percent by weight of water. The toner of this mixture comprised about 96.5 percent by weight of styrene/butyl acrylate/acrylic acid copolymer and about 3.5 percent by weight of pigment, and had a particle size of 6.6 microns in volume average diameter and a particle size distribution of 1.19 as measured with a Coulter Counter.

The resulting toner was used in the following Examples and Comparative Examples, first in a matrix of washing experiments (Examples II to V, Comparative Examples VI to IX) and in Example X and Comparative Example XI to, for example, compare the reproducibility of the washing procedures.

EXAMPLE II

900 Grams of the toner mixture of Example I were dispensed into a beaker and stirred with the aid of a mechanical stirrer to reslurry the toner water mixture. The toner slurry was brought to pH of 7.0 with the addition of about 20 grams of dilute aqueous 1.0 M KOH solution, stirred for 60 minutes, and filtered utilizing a Buchner filter funnel and 3 micron filter paper. About 185 grams of toner filter cake were recovered and reslurried in about 715 grams of deionized water. The resulting toner slurry was brought to pH of 7.0 with the addition of about 0.5 gram of dilute aqueous 1.0 M KOH solution, stirred for 60 minutes, and filtered. The aforementioned washing step was accomplished six times in total. Subsequently, the resulting toner was dried in a FTS Systems Dura-Dry™ freeze dryer for about 48 hours. The resulting product was toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate.

Thereafter, a developer mixture was prepared by mixing 1 gram of the prepared toner with 24 grams of carrier particles comprised of 65 micron steel core particles coated with a mixture of 20 percent by weight of CONDUCTEX SC ULTRA® carbon black dispersed in 80 percent of polymethyl methacrylate, and wherein the carrier coating weight was 1 percent. A sample of the developer mixture, about 5 to 10 grams, was placed into a 120 milliliter glass bottle and was retained in an environmental chamber at about 50 percent relative humidity for about 18 hours. The bottle was then sealed, and the contents were mixed by roll milling for 30 minutes to obtain a stable triboelectric charge. The toner charge was measured using the standard Faraday Cage tribo blow-off apparatus. For the toner of this Example, the triboelectric charge value at 50 percent relative humidity was −17.2 microcoulombs per gram, reference Table I.

In all of the Examples, the triboelectric charging properties were obtained in accordance with the aforementioned procedure.

EXAMPLE III

900 Grams of the toner mixture of Example I were dispensed into a beaker and stirred with the aid of a mechanical stirrer to reslurry the toner. The toner slurry was brought to pH of 7.0 with the addition of about 20 grams of dilute aqueous 1.0 M KOH solution, stirred for 60 minutes, and filtered utilizing a Buchner filter funnel and 3 micron filter paper. About 185 grams of toner filter cake were recovered and reslurried in about 715 grams of deionized water, stirred for 60 minutes, and filtered. No dilute aqueous KOH solution was added to the toner slurry. This aforementioned washing step was accomplished six times in total. Subsequently, the resulting toner was dried in a FTS Systems Dura-Dry™ freeze dryer for about 48 hours. The resulting toner comprises about 96.5 percent by weight of styrene/butyl acrylate/acrylic acid copolymer and about 3.5 percent by weight of pigment as determined by thermal gravimetric analysis, and contains less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −16.9 microcoulombs per gram, reference in Table I.

EXAMPLE IV

900 Grams of the toner mixture of Example I were dispensed into a beaker and stirred with the aid of a mechanical stirrer to reslurry the toner. The toner slurry was brought to pH of 8.5 with the addition of about 26.5 grams of dilute aqueous 1.0 M KOH solution, stirred for 60 minutes, and filtered utilizing a Buchner filter funnel and 3 micron filter paper. About 185 grams of toner filter cake were recovered and reslurried in about 715 grams of deionized water. The toner slurry was brought to pH of 8.5 with the addition of less than 0.5 gram of dilute aqueous 1.0 M KOH solution, stirred for 60 minutes, and filtered. This aforementioned washing step was accomplished six times in total. Subsequently, the resulting toner was dried in a FTS Systems Dura-Dry™ freeze dryer for about 48 hours. The resulting product was a toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value (subsequent to the preparation of a developer throughout) of this toner at 50 percent relative humidity was −25.3 microcoulombs per gram and was shown in Table I.

EXAMPLE V

900 Grams of the toner mixture of Example I were dispensed into a beaker and stirred with the aid of a mechanical stirrer to reslurry the toner. The toner slurry was brought to pH of 8.5 with the addition of about 26.5 grams of dilute aqueous 1.0 M KOH solution, stirred for 60 minutes, and filtered utilizing a Buchner filter funnel and 3 micron filter paper. About 185 grams of toner filter cake were recovered and reslurried in about 715 grams of deionized water, stirred for 60 minutes, and filtered. No dilute aqueous KOH solution was added to the toner slurry. This aforementioned washing step was carried out six times in total. Subsequently, the resulting toner was dried in a FTS Systems Dura-Dry™ freeze dryer for about 48 hours. The resulting product was a toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −25.3 microcoulombs per gram, reference Table I.

Comparative Example VI

900 Grams of the toner mixture of Example I were dispensed into a beaker, stirred with the aid of a mechanical stirrer to reslurry the toner, and filtered to remove the mother liquor utilizing a Buchner filter funnel and 3 micron filter paper. About 185 grams of toner filter cake were recovered and reslurried in about 715 grams of deionized water. The toner slurry was brought to pH of 7.0 with the addition of about 2 grams of dilute aqueous 1.0 M KOH solution, stirred for 60 minutes, and filtered. This aforementioned washing step was accomplished six times in total, with amounts of dilute aqueous 1.0 M KOH solution added in the second through sixth washing step amounting to less than 0.5 gram. Subsequently, the resulting toner was dried in a FTS Systems Dura-Dry™ freeze dryer for about 48 hours. The resulting product was toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −8.7 microcoulombs per gram, reference Table I.

Comparative Example VII

900 Grams of the toner mixture of Example I were dispensed into a beaker, stirred with the aid of a mechanical stirrer to reslurry the toner, and filtered utilizing a Buchner filter funnel and 3 micron filter paper. About 185 grams of toner filter cake were recovered and reslurried in about 715 grams of deionized water. The toner slurry was brought to pH of 7.0 with the addition of about 2 grams of dilute aqueous 1.0 M KOH solution, stirred for 60 minutes, and filtered. Again, about 185 grams of toner filter cake were recovered and reslurried in about 715 grams of deionized water, stirred for 60 minutes, and filtered. No dilute aqueous KOH solution was added to the toner slurry. This aforementioned washing step was carried out five times in total. Subsequently, the resulting toner was dried in a FTS Systems Dura-Dry™ freeze dryer for about 48 hours. The resulting product was a toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −6.8 microcoulombs per gram, reference Table I.

Comparative Example VIII

900 Grams of the toner mixture of Example I were dispensed into a beaker, stirred with the aid of a mechanical stirrer to reslurry the toner, and filtered (to remove the mother liquor which was not accomplished in Example III for example) utilizing a Buchner filter funnel and 3 micron filter paper. About 185 grams of toner filter cake were recovered and reslurried in about 715 grams of deionized water. The toner slurry was brought to pH of 8.5 with the addition of about 2.3 grams of dilute aqueous 1.0 M KOH solution, stirred for 60 minutes, and filtered. This aforementioned washing step was accomplished six times in total, with amounts of dilute aqueous 1.0 M KOH solution added in the second through sixth washing step amounting to less than 0.5 grams. Subsequently, the resulting toner was dried in a FTS Systems Dura-Dry™ freeze dryer for about 48 hours. The resulting product was toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −7.2 microcoulombs per gram, reference Table I.

Comparative Example IX

900 Grams of the toner mixture of Example I were dispensed into a beaker, stirred with the aid of a mechanical stirrer to reslurry the toner, and filtered utilizing a Buchner filter funnel and 3 micron filter paper. About 185 grams of toner filter cake were recovered and reslurried in about 715 grams of deionized water. The toner slurry was brought to pH of 8.5 with the addition of about 2.3 grams of dilute aqueous 1.0 M KOH solution, stirred for 60 minutes, and filtered. About 185 grams of toner filter cake were recovered and reslurried in about 715 grams of deionized water, stirred for 60 minutes, and filtered. No dilute aqueous KOH solution was added to the toner slurry. This aforementioned washing step was washed five times in total. Subsequently, the resulting toner was dried in a FTS Systems Dura-Dry™ freeze dryer for about 48 hours. The resulting product was a toner comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge value of this toner at 50 percent relative humidity was −9.7 microcoulombs per gram, reference Table I.

TABLE I

Tribo Values from Examples II to V and Comparative Examples VI to IX

| Example | pH Adjustment Before/After 1st Filtration | pH | pH Adjustment at Start of Each Wash | 50% RH Tribo Microcoulomb/ Gram |
|---|---|---|---|---|
| II | Before | 7.0 | Yes | −17.2 |
| III | Before | 7.0 | No | −16.9 |
| IV | Before | 8.5 | Yes | −25.3 |
| V | Before | 8.5 | No | −25.3 |
| Comp VI | After | 7.0 | Yes | −8.7 |
| Comp VII | After | 7.0 | No | −6.8 |
| Comp VIII | After | 8.5 | Yes | −7.2 |
| Comp IX | After | 8.5 | No | −9.7 |

From Table I, it can be seen that pH adjustment of the toner slurry before removal of the aqueous phase has the greatest impact on triboelectric charge improvement. Toners washed at pH 8.5 have a higher charge than toners washed at pH 7.0. pH adjustment in subsequent washes with deionized water seems to have little effect on triboelectric charge performance of the toners.

EXAMPLE X

Five batches of dried toner were produced by the process of Example IV utilizing the toner mixture of Example I. For each batch, 900 grams of the toner mixture were dispensed into a beaker and stirred with the aid of a mechanical stirrer to reslurry the toner. The toner slurry was brought to pH of 8.5 with the addition of about 26.5 grams of dilute aqueous 1.0 M KOH solution, stirred for 60 minutes, and filtered utilizing a Buchner filter funnel and 3 micron filter paper. About 185 grams of toner filter cake were recovered and reslurried in about 715 grams of deionized water. The toner slurry was brought to pH of 8.5 with the addition of less than 0.5 gram of dilute aqueous KOH solution, stirred for 60 minutes, and filtered. This aforementioned washing step was carried out six times in total. Subsequently, the resulting toner was dried in a FTS Systems Dura-Dry™ freeze dryer for about 48 hours. The resulting product from each of the batches had substantially the same composition comprising about 96.5 percent by weight of styrene/butyl acrylate/acrylic acid copolymer and about 3.5 percent by weight of pigment as determined by thermal gravimetric analysis, and containing less than 2 percent by weight of surfactant as determined by liquid chromatography, capillary electrophoresis and gas chromatography, and containing less than 1 percent by weight of water as determined gravimetrically utilizing a hot plate. The triboelectric charge values of the five toner samples at 50 percent relative humidity were measured by the standard Faraday Cage tribo blow-off procedure described in Example II, and were shown in Table II. The average triboelectric charge value of the five toner samples was −25.48 microcoulombs per gram with a standard deviation of 0.34 microcoulombs per gram.

Comparative Example XI

Five batches of dried toner were produced by the process of Comparative Example VIII utilizing the toner mixture of Example I. For each batch 900 grams of the toner mixture were dispensed into a beaker, stirred with the aid of a mechanical stirrer to reslurry the toner, and filtered to remove water utilizing a Buchner filter funnel and 3 micron filter paper. About 185 grams of toner filter cake were recovered and reslurried in about 715 grams of deionized water. The toner slurry was brought to pH of 8.5 with the addition of about 2.3 grams of dilute aqueous 1.0 M KOH solution, stirred for 60 minutes, and filtered. This aforementioned washing step was carried out six times in total, with amounts of dilute aqueous 1.0 M KOH solution added in the second through sixth washing step amounting to less than 0.5 gram. Subsequently, the resulting toner was dried in a FTS Systems Dura-Dry™ freeze dryer for about 48 hours. The triboelectric charge values of the five toner samples at 50 percent relative humidity were measured by the standard Faraday Cage tribo blow-off procedure and after preparation of a developer as described in Example II, and were shown in Table II. The average triboelectric charge value of the five toner samples was −7.66 microcoulombs per gram with a standard deviation of 1.64 microcoulombs per gram which was more than four times the standard deviation obtained in Example X. Therefore, the process of the present invention in which pH adjustment was carried out on the coalesced toner mixture before filtration and removal of the aqueous phase, was more reproducible than the process in which pH adjustment was carried out on the reslurried toner after the first filtration as illustrated by the standard deviation of charge performance of the resultant toners.

TABLE II

Tribo Values of Example X and Comparative Example XI

| 50% RH Tribo microcoulomb/gram | Example X | Comparative Example XI |
|---|---|---|
| Sample 1 | −25.3 | −7.2 |
| Sample 2 | −25.6 | −10.1 |
| Sample 3 | −25.4 | −5.9 |
| Sample 4 | −26.0 | −8.4 |
| Sample 5 | −25.1 | −6.7 |
| Average Tribo | −25.48 | −7.66 |
| Standard Deviation | 0.34 | 1.64 |

Other embodiments and modifications of the present invention may occur to those skilled in the art subsequent to a review of the information presented herein; these embodiments and modifications, as well as equivalents thereof, are also included within the scope of the present invention.

What is claimed is:

1. A process for the preparation of toner comprising mixing a colorant dispersion in water, which dispersion is comprised of a colorant and an ionic surfactant with a resin latex; heating the resulting flocculent mixture at a temperature of from about 25° C. to about 1° C. below the glass transition temperature (Tg) of the latex resin to effect formation of toner sized aggregates; heating the resulting aggregate suspension in the presence of additional anionic surfactant, and which heating is at a temperature of from about 10° C. to about 55° C. above the Tg of the resin; cooling; adding a base component to the resulting slurry; subsequently filtering said resulting slurry; and thereafter optionally drying said toner.

2. A process in accordance with claim 1 wherein the base component is added to said toner slurry containing water, and (i) adding a base component to the resulting toner mixture in an amount to increase the pH of said mixture to a basic pH in the range of from about 7 to about 12;

(ii) stirring the toner mixture;

(iii) removing the toner from the mixture;

(iv) reslurrying the recovered toner by adding water in an amount from about 100 to about 2,000 percent by weight of toner;

(v) optionally adding base to the resulting toner mixture in an amount to increase the pH of said mixture to about 7 to about 12;

(vi) stirring the toner mixture;

(vii) removing the toner from the mixture; and (viii) repeating the aforementioned washing (iv) to (vii) from 1 to about 20 times.

3. A process in accordance with claim 1 wherein the toner aggregate size, and the final toner particle size is from about 1 to about 20 microns in volume average diameter, and which heating at a temperature of from about 10° C. to about 55° C. above the Tg of the latex resin forms integral toner particles comprised of a polymeric resin, and colorant, and wherein the base is an alkali metal hydroxide.

4. A process in accordance with claim 1 wherein there is formed said toner aggregates with a narrow size distribution, or GSD of from about 1.15 to about 1.25.

5. A process in accordance with claim 1 wherein the ionic surfactant contained in the colorant dispersion is a cationic surfactant, and there is present in the latex an anionic or nonionic surfactant.

6. A process in accordance with claim 1 wherein the dispersion is generated by homogenizing at from about 1,000 revolutions per minute to about 10,000 revolutions per minute by microfluidization in a microfluidizer or in nanojet, or by an ultrasonic probe at from about 300 watts to about 900 watts of energy at a temperature of from about 25° C. to about 35° C. for a duration of from about 1 minute to about 120 minutes.

7. A process in accordance with claim 1 wherein the heating of the flocculent mixture of latex, colorant, and surfactants is accomplished at temperatures of from about 2° C. to about 10° C. below the resin Tg for a duration of from about 30 minutes to about 6 hours.

8. A process in accordance with claim 5 wherein the surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly (ethyleneoxy)ethanol; and wherein the anionic surfactant is selected from the group consisting of sodium dodecyl sulfate, sodium dodecylbenzene sulfate, and sodium dodecylnaphthalene sulfate.

9. A process in accordance with claim 1 wherein the base is sodium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, or barium carbonate.

10. A process in accordance with claim 1 wherein the colorant dispersion is in water and is comprised of a colorant and an ionic surfactant; the latex contains an ionic surfactant having an opposite charge polarity to that of said ionic surfactant in the colorant dispersion, thereby causing a flocculation of the resin, colorant, and surfactants; wherein heating the resulting flocculent mixture is at a temperature of from about 25° C. to about 1° C. below the glass transition temperature (Tg) of the resin to effect formation of toner sized aggregates, and wherein the resin has a Tg of from about 45° C. to about 65° C.; wherein heating the resulting aggregate suspension is accomplished in the presence of additional anionic surfactant, and which heating is at a temperature of from about 10° C. to about 55° C. above the Tg of the resin to form a toner slurry mixture; adding said base; filtering to remove water; cooling and separating said toner, and thereafter drying said toner.

11. A process in accordance with claim 5 wherein the nonionic surfactant selected is present in an amount of from about 1 percent to about 5 percent by weight of toner.

12. A process in accordance with claim 1 wherein the base is selected in an amount of from about 1 percent to about 20 percent by weight of toner.

13. A process in accordance with claim 1 wherein the latex contains a polymer or resin of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butyl acrylate-acrylic acid), poly(styrene-butyl acrylate-methacrylic acid), poly(styrene-butyl acrylate-acrylonitrile), or poly(styrene-butyl acrylate-acrylonitrile-acrylic acid).

14. A process in accordance with claim 1 wherein the latex contains a polymer or resin of styrene acrylate, or a styrene methacrylate.

15. A process in accordance with claim 13 wherein the resin is selected in an amount of from about 85 weight percent to about 98 weight percent of toner.

16. A process in accordance with claim 1 wherein washing of said toner is accomplished by the repeated reslurrying of toner with water.

17. A process in accordance with claim 1 wherein washing is accomplished by the repeated reslurrying of toner with water, which washing is accomplished by stirring and separation of toner from aqueous phase, and wherein said washing removes residual surfactants.

18. A process in accordance with claim 1 wherein further base is added subsequent to filtering.

19. A process in accordance with claim 1 wherein said base is potassium hydroxide.

20. A process in accordance with claim 18 wherein said base is potassium hydroxide.

21. A process for the preparation of toner comprising mixing a colorant and a latex containing a surfactant; heating the mixture resulting to about equal to or about below the Tg of the polymer contained in the latex, heating the resulting mixture to about equal to or above about the polymer Tg; adding a base to the resulting toner mixture; and thereafter filtering the mixture and mixing the filtered toner with water followed by the addition of a further base, then filtering.

22. A process in accordance with claim 21 wherein the resultant toner is isolated subsequent to filtration.

23. A process in accordance with claim 1 wherein subsequent to filtering the said toner is admixed with water followed by the addition of a base, then filtering, and which sequence is repeated from 1 to about 20 times.

24. A process in accordance with claim 23 wherein the base is an alkali metal hydroxide.

25. A process in accordance with claim 1 wherein after addition of said base the pH of the mixture is from about 7 to about 12.

26. A process in accordance with claim 1 wherein said base is an alkali metal hydroxide.

27. A process in accordance with claim 3 wherein said base is an alkali metal hydroxide.

* * * * *